US010722998B2

(12) United States Patent
Hsu et al.

(10) Patent No.: US 10,722,998 B2
(45) Date of Patent: Jul. 28, 2020

(54) WAFER POLISHING PAD AND USING METHOD THEREOF

(71) Applicant: UNITED MICROELECTRONICS CORP., Hsin-Chu (TW)

(72) Inventors: Li-Chieh Hsu, Taichung (TW); Fu-Shou Tsai, Keelung (TW); Kun-Ju Li, Tainan (TW); Po-Cheng Huang, Kaohsiung (TW); Chun-Liang Liu, Hsinchu (TW)

(73) Assignee: UNITED MICROELECTRONICS CORP., Hsin-Chu (TW)

( * ) Notice: Subject to any disclaimer, the term of this patent is extended or adjusted under 35 U.S.C. 154(b) by 0 days.

(21) Appl. No.: 15/719,515

(22) Filed: Sep. 28, 2017

(65) Prior Publication Data

US 2019/0070706 A1 Mar. 7, 2019

(30) Foreign Application Priority Data

Sep. 5, 2017 (CN) ..... 2017 1 0790045

(51) Int. Cl.
*B24B 37/24* (2012.01)
*B24B 37/22* (2012.01)
*B24B 37/26* (2012.01)

(52) U.S. Cl.
CPC ..... *B24B 37/22* (2013.01); *B24B 37/24* (2013.01); *B24B 37/26* (2013.01); *B24D 2205/00* (2013.01)

(58) Field of Classification Search
CPC ..... B24B 37/26; B24B 37/22; B24B 37/24; B24B 37/205; B29C 64/112; H01L 21/32115; H01L 21/30625; B24D 2205/00
USPC ..... 156/345.12, 345.14, 345.15; 430/6; 438/692.693
See application file for complete search history.

(56) References Cited

U.S. PATENT DOCUMENTS 5,913,713 A * 6/1999 Cheek ..... B24B 37/26 451/285
2002/0182986 A1* 12/2002 Tung ..... B24B 37/20 451/56
2004/0256055 A1* 12/2004 Grunwald ..... B24B 37/24 156/345.12
2005/0173259 A1* 8/2005 Mavliev ..... B23H 5/08 205/645

(Continued)

FOREIGN PATENT DOCUMENTS

CN 1535197 A 10/2004
CN 101193728 A 6/2008

*Primary Examiner* — Lan Vinh
(74) *Attorney, Agent, or Firm* — Winston Hsu

(57) ABSTRACT

The present invention provides a wafer polishing pad, the wafer polishing pad includes a polishing material layer, a plurality of recesses are formed on the top surface of the polishing material layer, and a warning element disposed within the polishing material layer, the warning element and the polishing material layer have different colors. The feature of the invention is that forming a warning element in the polishing material layer, when the visible state of the warning element is changed, for example, when the warning element appears, disappears or changes the shapes, it means that the wafer polishing pad needs to be replaced. In this way, the user can confirm the destroying situation of the wafer polishing pad easily, and also improving the manufacturing process efficiency.

4 Claims, 9 Drawing Sheets

(56) References Cited

U.S. PATENT DOCUMENTS

| | | | | |
|---|---|---|---|---|
| 2007/0049168 | A1* | 3/2007 | Fujita | B24B 49/12 451/6 |
| 2007/0218806 | A1* | 9/2007 | Kistler | B24B 37/013 451/5 |
| 2008/0248734 | A1* | 10/2008 | Bajaj | B24B 37/26 451/287 |
| 2013/0189906 | A1* | 7/2013 | Bajaj | B24B 53/017 451/56 |

* cited by examiner

WAFER POLISHING PAD AND USING METHOD THEREOF

BACKGROUND OF THE INVENTION

1. Field of the Invention

The present invention relates to a semiconductor process, and more particularly to a disc or wafer polishing pad structure for a chemical mechanical polishing process.

2. Description of the Prior Art

In semiconductor processes, chemical mechanical polishing (CMP) is a common step for grinding or polishing various components. In the CMP process using a disc (or a wafer polishing pad) to polish wafers and other semiconductor components, the wafer polishing pad is a consumable item, which needs to be replaced regularly.

However, according to actual operating parameters, the destroyed rate of the wafer polishing pad may be accelerated, resulting in a situation that the wafer polishing pad needs to be replaced before the scheduled time. But the user cannot only by visual observation to determine whether the wafer polishing pad needs to be replaced. If the user disassembles the machine to check the destroying situation of the wafer polishing pad, whether replacing the wafer polishing pad or not, it takes a lot of time to reset the machine. It also reduces the production rate.

SUMMARY OF THE INVENTION

The present invention provides a wafer polishing pad, the wafer polishing pad includes a polishing material layer, a plurality of recesses are formed on the top surface of the polishing material layer, and a warning element disposed within the polishing material layer, wherein the warning element and the polishing material layer have different colors.

The present invention further provides a method for using a wafer polishing pad, the method includes: a wafer is provided, a wafer polishing pad is provided, the wafer polishing pad includes a polishing material layer, a plurality of recesses are formed on the top surface of the polishing material layer, and a warning element located within the polishing material layer, wherein the warning element and the polishing material layer have different colors, and a polishing step is then performed, using the wafer polishing pad to polish the wafer, wherein at least parts of the warning element is partially removed during the polishing step.

One feature of the present invention is that forming an additional warning element in the wafer polishing pad, when the visible state of the warning element changes (e.g., when the warning element appears, disappears or the shape of the warning element is changed), it represents the wafer polishing pad needs to be replaced. In this way, the user will be able to easily confirm the destroying situation of the wafer polishing pad and improve the overall process efficiency.

These and other objectives of the present invention will no doubt become obvious to those of ordinary skill in the art after reading the following detailed description of the preferred embodiment that is illustrated in the various figures and drawings.

DETAILED DESCRIPTION

To provide a better understanding of the present invention to users skilled in the technology of the present invention, preferred embodiments are detailed as follows. The preferred embodiments of the present invention are illustrated in the accompanying drawings with numbered elements to clarify the contents and the effects to be achieved.

Please note that the figures are only for illustration and the figures may not be to scale. The scale may be further modified according to different design considerations. When referring to the words "up" or "down" that describe the relationship between components in the text, it is well known in the art and should be clearly understood that these words refer to relative positions that can be inverted to obtain a similar structure, and these structures should therefore not be precluded from the scope of the claims in the present invention.

Figure 1:
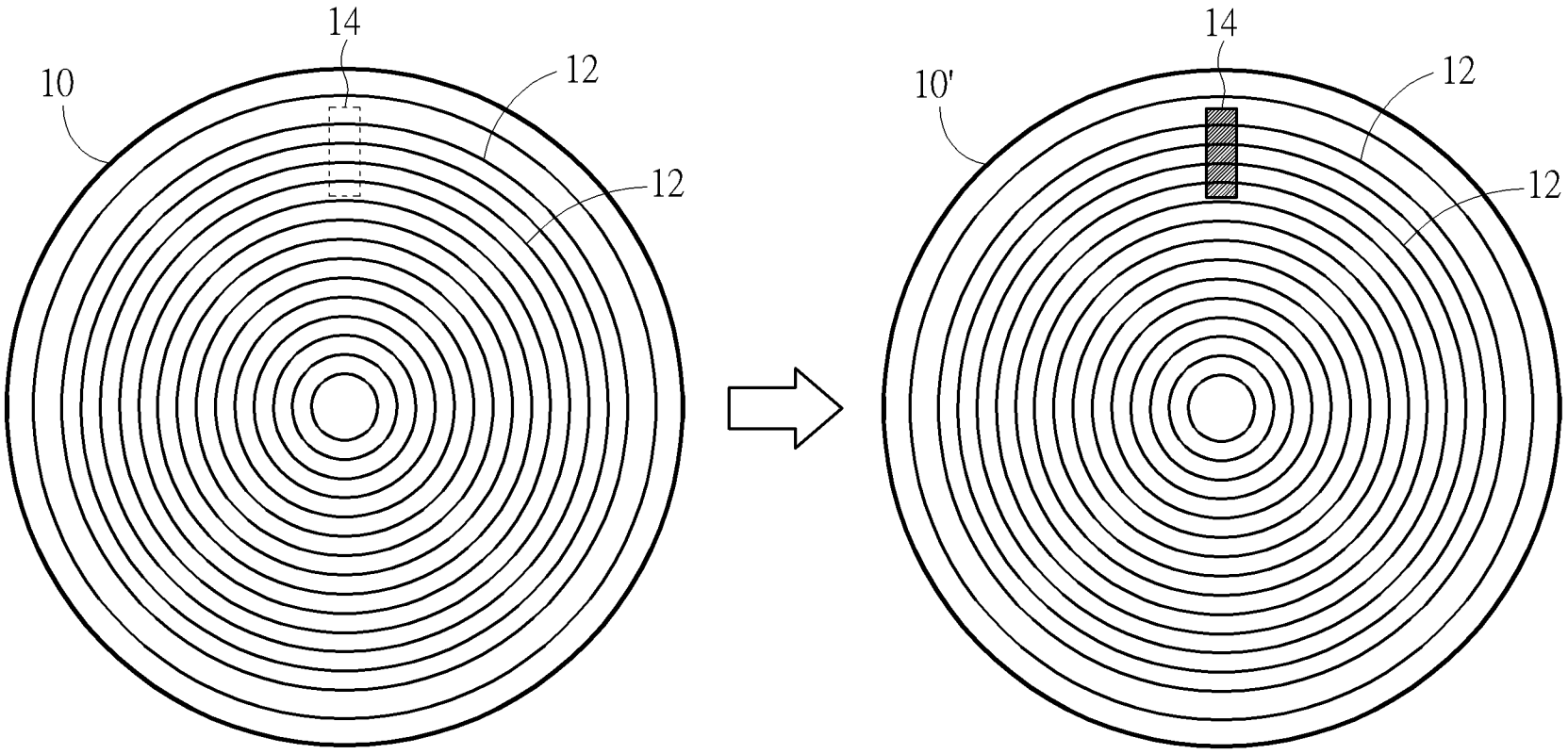
FIG. 1 shows the top view schematic structures of a new wafer polishing pad and a used wafer polishing pad which is required to be replaced respectively according to the first preferred embodiment of the present invention.
Figure 2:
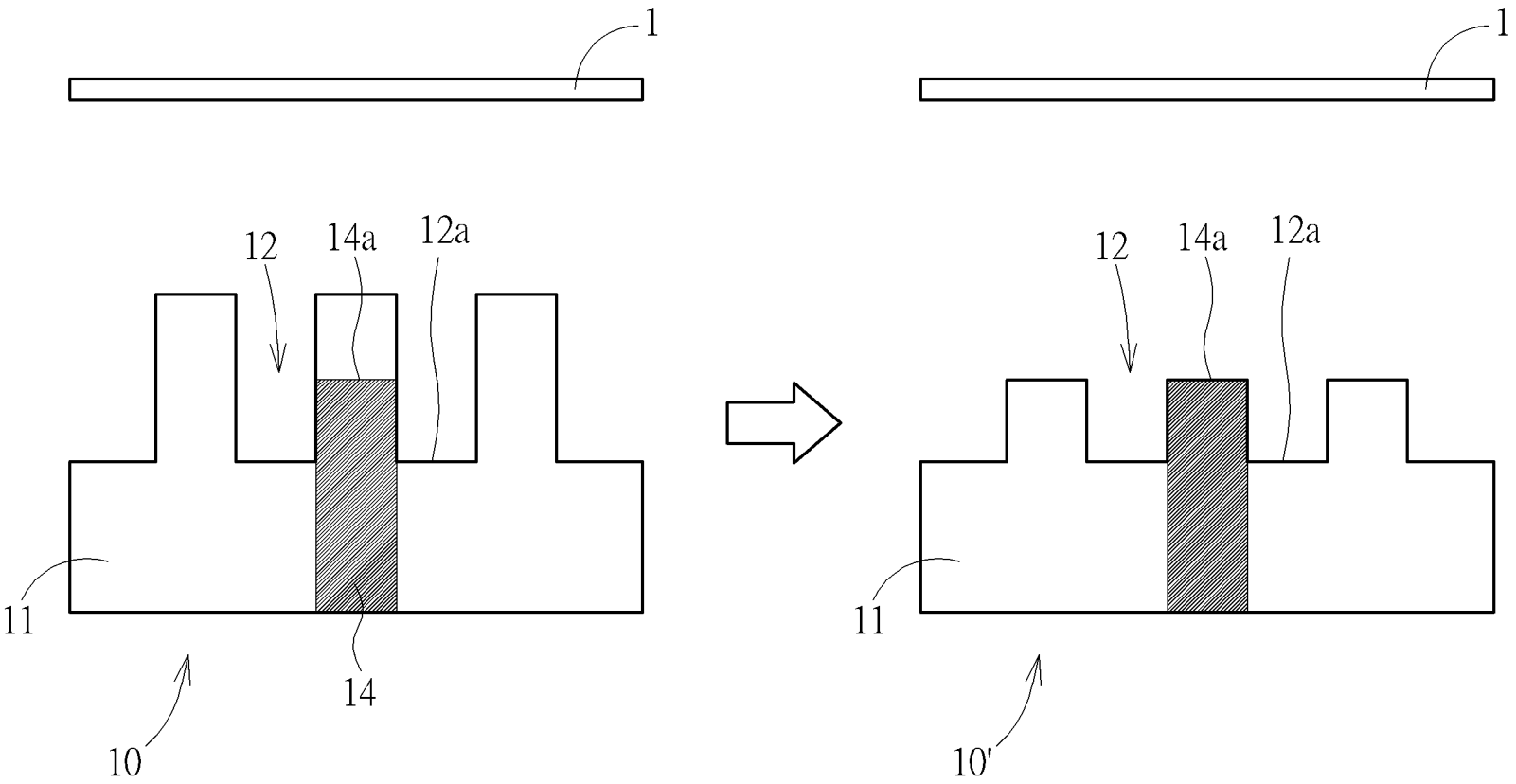
FIG. 2 shows the partial cross-sectional view structures of the wafer polishing pad of FIG. 1 respectively.

Referring to FIG. 1 and FIG. 2, FIG. 1 shows the top view schematic structures of a new wafer polishing pad and a used wafer polishing pad which is required to be replaced respectively according to the first preferred embodiment of the present invention. FIG. 2 shows the partial cross-sectional view structures of the wafer polishing pad of FIG. 1 respectively. As shown in FIGS. 1-2, in the first embodiment of the present invention, at least one wafer 1 is provided, and a wafer polishing pad (or a disc) 10 is used to polish the wafer 1, the left wafer polishing pad 10 is a new wafer polishing pad before used, and the right wafer polishing pad 10' is in a state after the wafer polishing pad 10 has been used for a period of time, and needs to be replaced. FIG. 2 shows the cross section views of the wafer polishing pad 10 and the wafer polishing pad 10' respectively. In general, the wafer polishing pad 10 includes a polishing material layer 11, the polishing material layer 11 includes materials such as polyurethane, and a plurality of recesses 12 are disposed at the top portion of the polishing material layer 11. When views in the top view, the recesses 12 are arranged concentrically, but are not limited thereto. During the chemical mechanical polishing step, the slurry (not shown) is accommodated in the recesses 12 to facilitate polishing the wafer. After the wafer polishing pad 10 is used for a period of time, or while the frequency for polishing the wafers is increased, the wafer polishing pad 10 is gradually destroyed or consumed. In other words, the recesses 12 are gradually becoming shallower and cannot accommodate the slurry effectively, thereby reducing the polishing efficiency, so that the wafer polishing pad 10 needs to be replaced.

The present invention is characterized in that a warning element 14 is embedded in the polishing material layer 11 of the wafer polishing pad 10. The warning element 14 is preferably made of the material same as the material of the polishing material layer 11, but the warning element 14 and the polishing material layer 11 have different colors, such as polyimide, but not limited thereto. In practical, during the process for forming the wafer polishing pad 10, a portion of the polishing material layer 11 can be dyed or can be made by other suitable processes to produce the warning element 14. The color of the warning element 14 and the polishing material layer 11 is not particularly limited as long as the contrast of the two colors is sufficient to be observed by naked eye or an optical detecting element (e.g., a camera). For example, if the warning element is yellow color, the polishing material layer may be black color; if the warning element is light red color, the polishing material layer may be dark red color. As shown in FIG. 1 and FIG. 2, at beginning, the warning element 14 is covered by the polishing material layer 11, so that the warning element 14 cannot be seen from the top view. However, when the wafer polishing pad 10 is depleted and needs to be replaced (see the wafer polishing pad 10' on the right side), the polishing material layer 11 that disposed above the warning element 14 is completely removed, thereby exposing the warning element 14 (at this time, a small portion of the warning element 14 may also be removed). Since the warning element 14 has different color with the color of the polishing material layer 11, the warning element 14 can be clearly observed from the top view. It means that the wafer polishing pad 10 needs to be replaced when the user saw the warning element 14 from the top view. It is also noted that a top surface 14*a* of the warning element 14 needs to be higher than a bottom surface 12*a* of the recess 12, to ensure that the wafer polishing pad 10 is replaced before the recess 12 is fully flattened.

Figure 3:
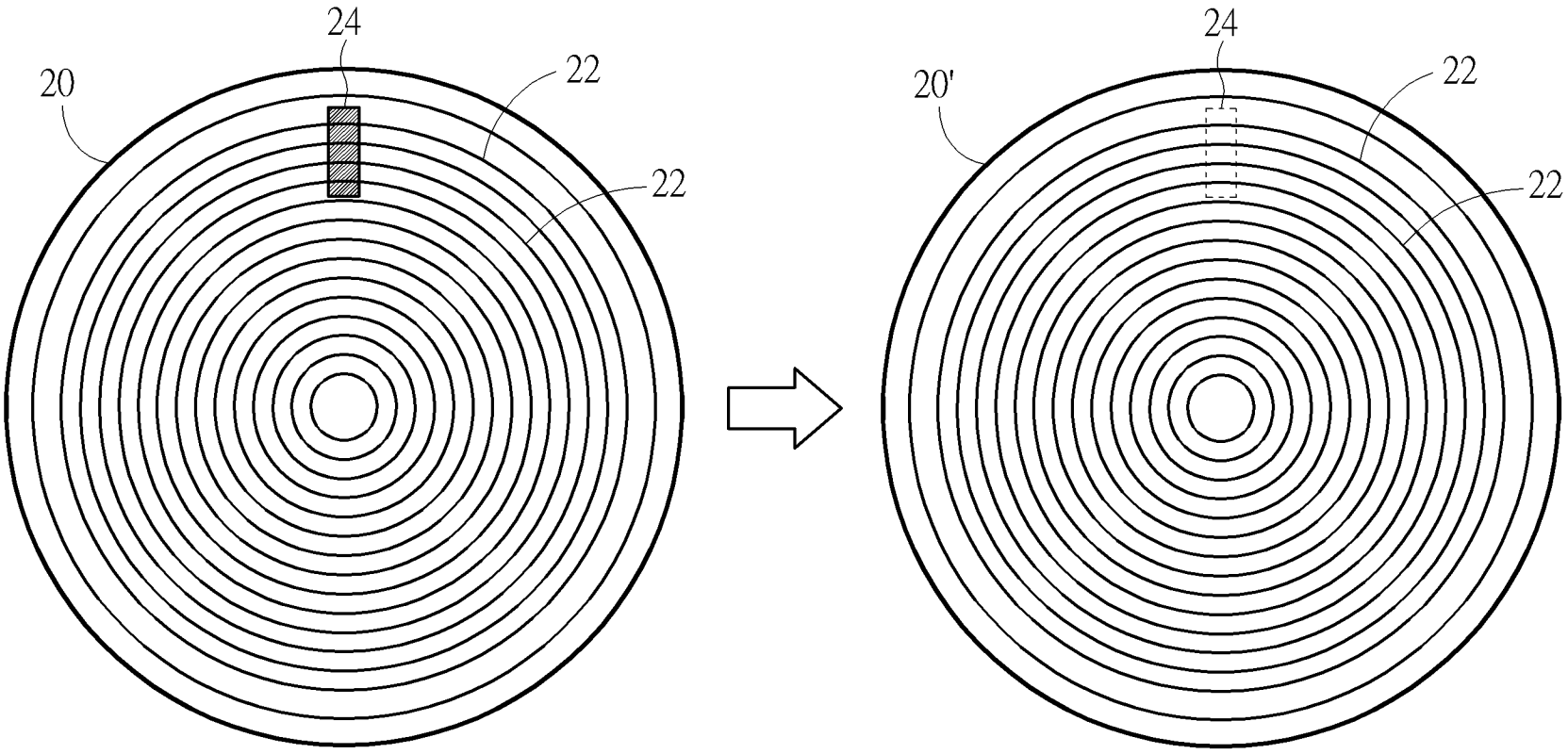
FIG. 3 shows the top view schematic structures of a new wafer polishing pad and a used wafer polishing pad which is required to be replaced respectively according to the second preferred embodiment of the present invention.
Figure 4:
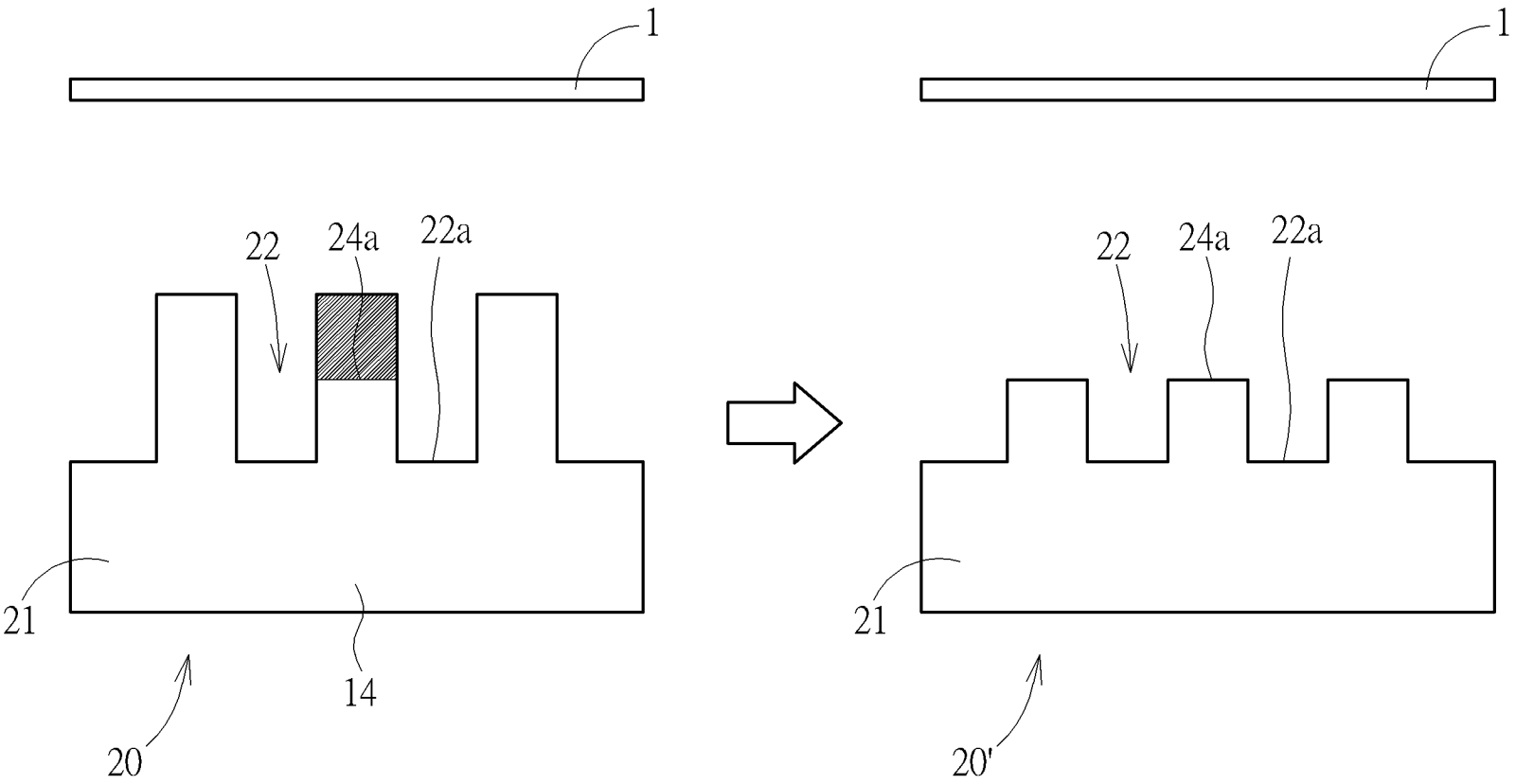
FIG. 4 shows the partial cross-sectional view structures of the wafer polishing pad of FIG. 3 respectively.

Referring to FIG. 3 and FIG. 4, FIG. 3 shows the top view schematic structures of a new wafer polishing pad and a used wafer polishing pad which is required to be replaced respectively according to the second preferred embodiment of the present invention. FIG. 4 shows the partial cross-sectional view structures of the wafer polishing pad of FIG. 3 respectively. As shown in FIG. 3 and FIG. 4, in the second embodiment of the present invention, at least one wafer 1 is provided, and a wafer polishing pad (or a disc) 20 is used to polish the wafer 1, where the left wafer polishing pad 20 is a new wafer polishing pad before used, and the right wafer polishing pad 20' is in a state after the wafer polishing pad 20 has been used for a period of time, and needs to be replaced. FIG. 4 shows the cross section views of the wafer polishing pad 20 and the wafer polishing pad 20' respectively. The warning element 24 is preferably made of the material same as the material of the polishing material layer 21, but the warning element 24 and the polishing material layer 21 have different colors, such as polyimide, but not limited thereto. In practical, during the process for forming the wafer polishing pad 20, a portion of the polishing material layer 21 can be dyed or can be made by other suitable processes to produce the warning element 24. The difference between this embodiment and the first preferred embodiment is that the warning element 24 is formed on a top portion of the wafer polishing pad 20, and the warning element 24 is exposed at beginning. In other words, the warning element 24 can be seen from the top view. Afterwards, when the wafer polishing pad is depleted and needs to be replaced (see the wafer polishing pad 20' on the right side), the warning element 24 is completely removed and the warning element disappears, it means that when the user found that the warning element 24 disappears, the wafer polishing pad needs to be replaced. It is also noted that the bottom surface 24*a* of the warning element 24 needs to be higher than the bottom surface 22*a* of the recess 22, to ensure that the wafer polishing pad is replaced before the recess 12 is fully flattened.

In the first embodiment and the second embodiment described above, although only one single warning element 14 or one warning element 24 is shown, the present invention is not limited thereto. In the present invention, one wafer polishing pad may include a plurality of warning elements, is should also be within the scope of the present invention. In addition, the shape, size, arrangement direction of the warning element may be adjusted according to actual demands, and the present invention is not limited thereto.

Figure 5:
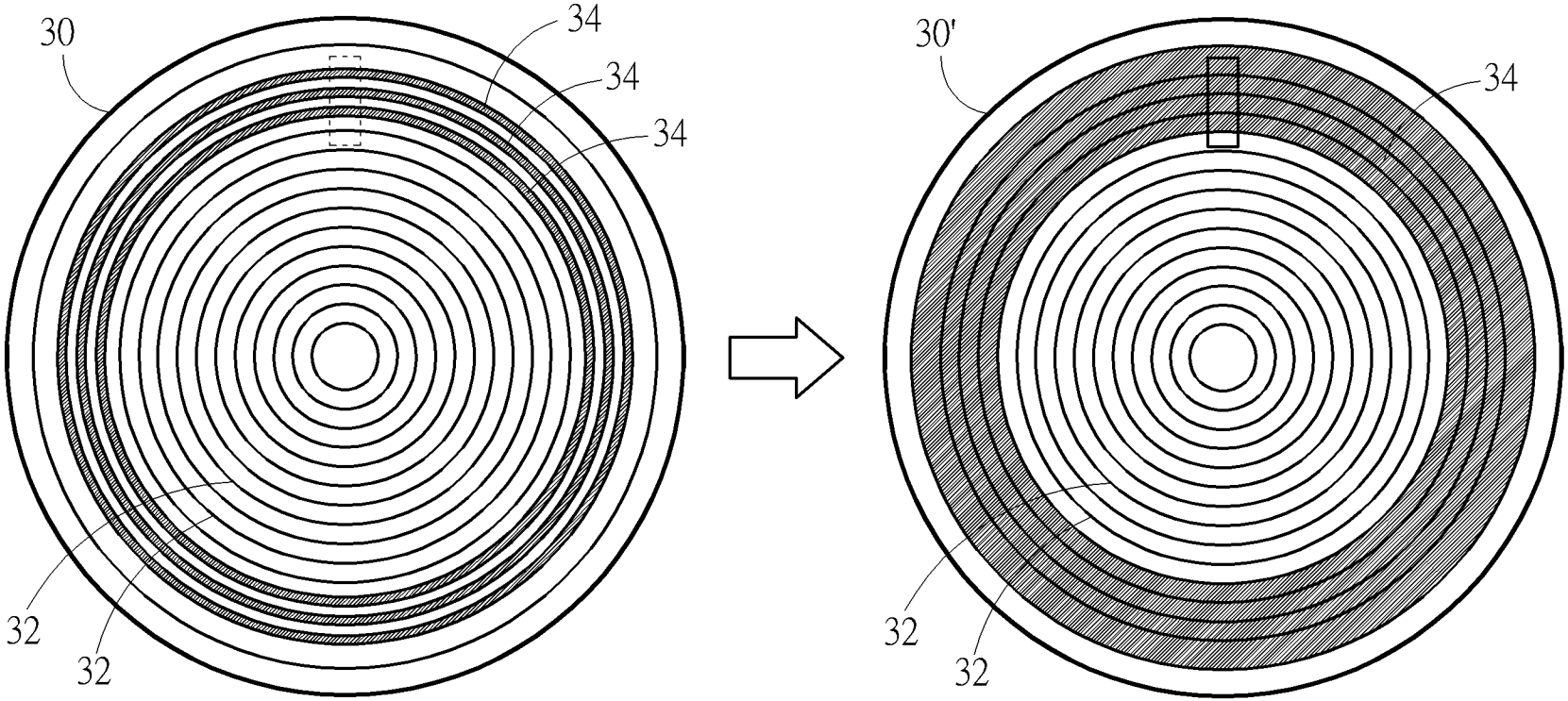
FIG. 5 shows the top view schematic structures of a new wafer polishing pad and a used wafer polishing pad which is required to be replaced respectively according to the third preferred embodiment of the present invention.
Figure 6:
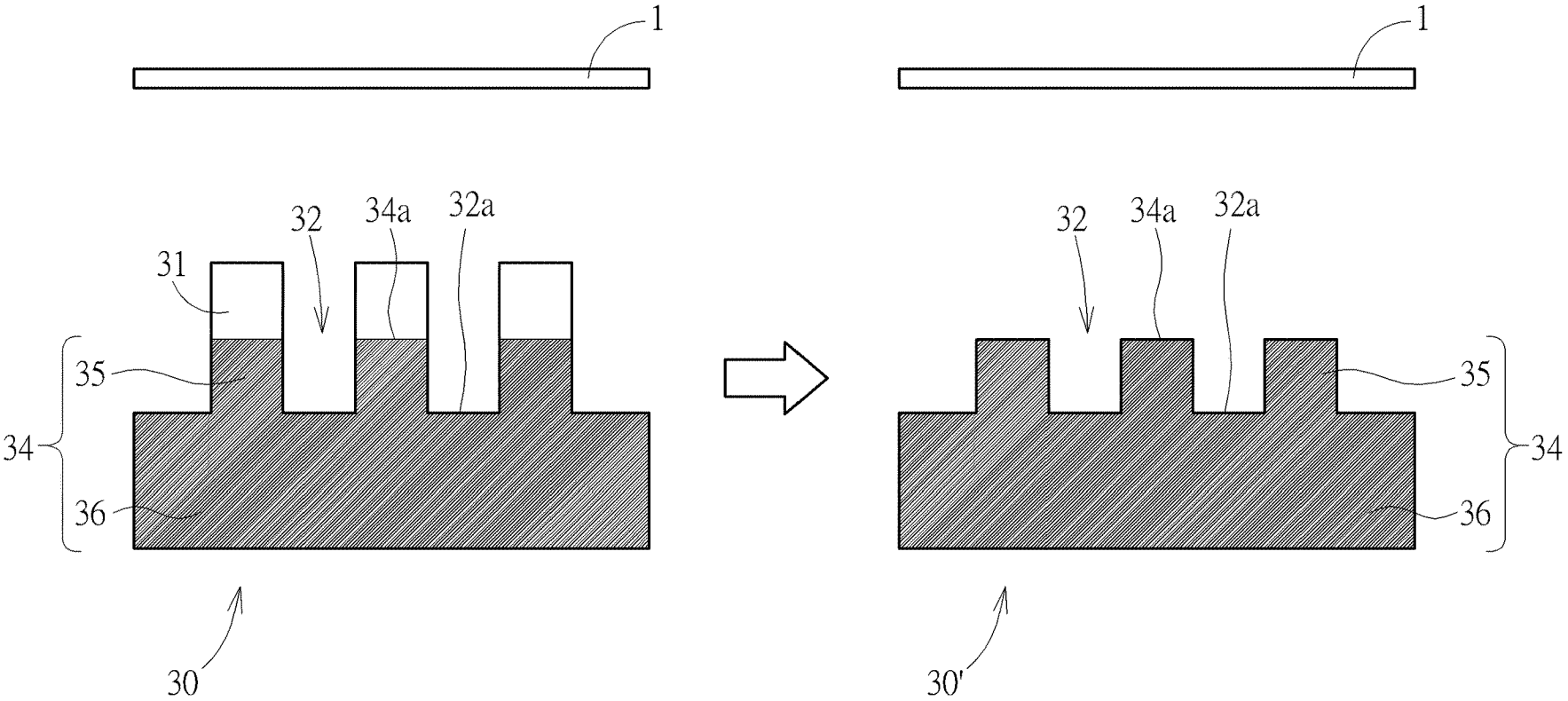
FIG. 6 shows the partial cross-sectional view structures of the wafer polishing pad of FIG. 5 respectively.

Referring to FIG. 5 and FIG. 6, FIG. 5 shows the top view schematic structures of a new wafer polishing pad and a used wafer polishing pad which is required to be replaced respectively according to the third preferred embodiment of the present invention. FIG. 6 shows the partial cross-sectional view structures of the wafer polishing pad of FIG. 5 respectively. As shown in FIG. 5 and FIG. 6, in the third embodiment of the present invention, at least one wafer 1 is provided, and a wafer polishing pad (or a disc) 30 is used to polish the wafer 1, the left wafer polishing pad 30 is a new wafer polishing pad before used, and the right wafer polishing pad 30' is in a state after the wafer polishing pad 30 has been used for a period of time, and needs to be replaced. FIG. 6 shows the cross section views of the wafer polishing pad 30 and the wafer polishing pad 30' respectively. The warning element 34 is preferably made of the material same as the material of the polishing material layer 31, but the warning element 34 and the polishing material layer 31 have different colors, such as polyimide, but not limited thereto. In practical, during the process for forming the wafer polishing pad 30, a portion of the polishing material layer 31 can be dyed or can be made by other suitable processes to produce the warning element 34. In addition, in the present embodiment, the warning element 34 has an upper half 35 and a lower half 36, and the upper half 35 and the lower half 36 have different shapes. More precisely, when views in a top view, the upper half 35 and the lower half 36 have different shapes. In the present embodiment, for example, the upper half 35 of the warning element 34 includes a plurality of concentric annular structures, and the lower half 36 of the warning element 34 is a ring-like structure having thicker wire diameter. But the present invention is not limited thereto, and the warning element may include other shapes.

Continuing with reference to FIG. 5 and FIG. 6, the upper half 35 of the warning element 34 is completely covered by the polishing material layer 31, so that only the lower half 36 of the warning element 34 can be seen from the top view, but the upper half 35 cannot be seen. In the present embodiment, for example, a plurality of concentric annular structures can be seen from the top view. However, when the wafer polishing pad is depleted and needs to be replaced (see the wafer polishing pad 30' on the right side), the polishing material layer 31 covering the upper half 35 of the warning element 34 is completely removed, thereby exposing the upper half 35 of the warning element 34 (At this time, the warning element 34 may also be removed by a small part). In the present embodiment, for example, from the top view, the plurality of concentric annular structures will become a ring-like structure having thicker wire diameter. It means that when the user founds the shape of the warning element is changed, it is necessary to replace the wafer polishing pad. It is also noted that the top surface 34*a* of the warning element 34 needs to be higher than the bottom surface 32*a* of the recess 32, to ensure that the wafer polishing pad is replaced before the recess 32 is fully flattened.

Figure 7:
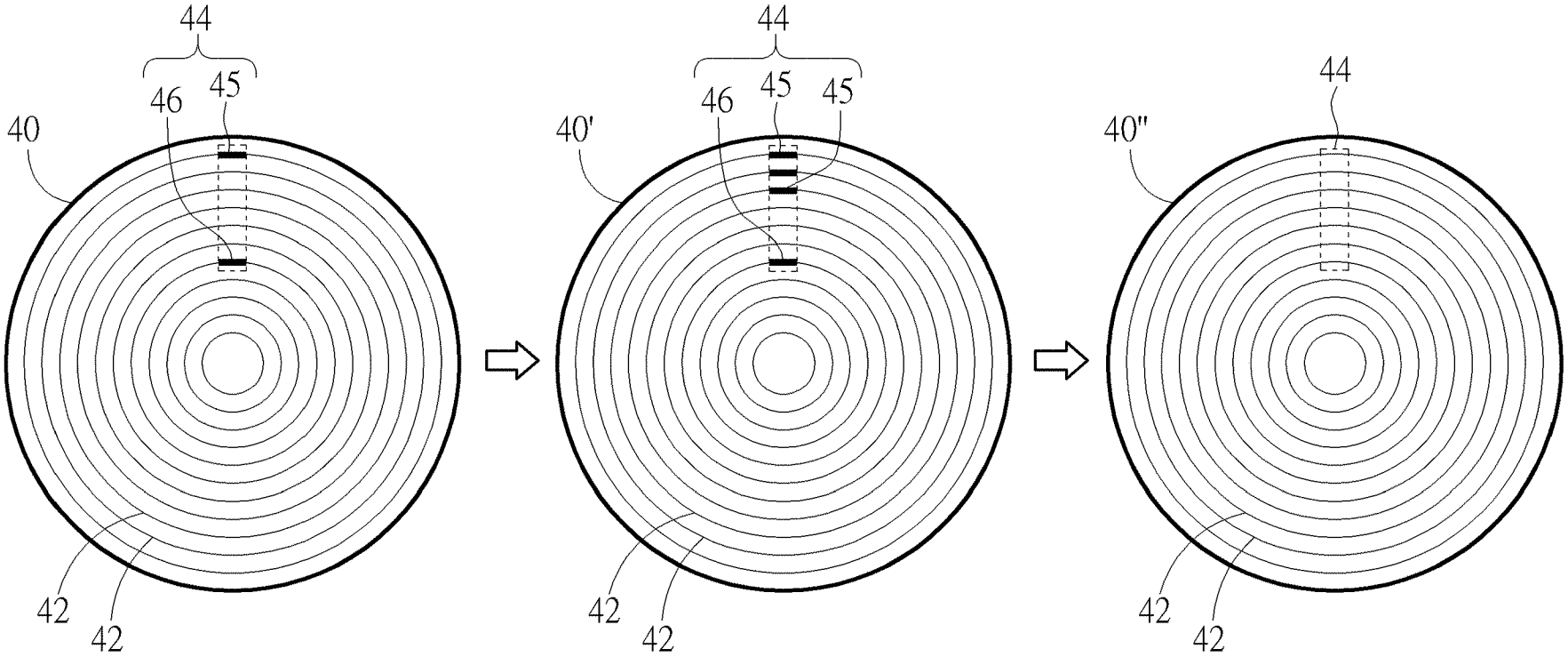
FIG. 7 shows the top view schematic structures of a new wafer polishing pad, a using polishing pad and a used wafer polishing pad which is required to be replaced respectively according to the fourth preferred embodiment of the present invention.
Figure 8:
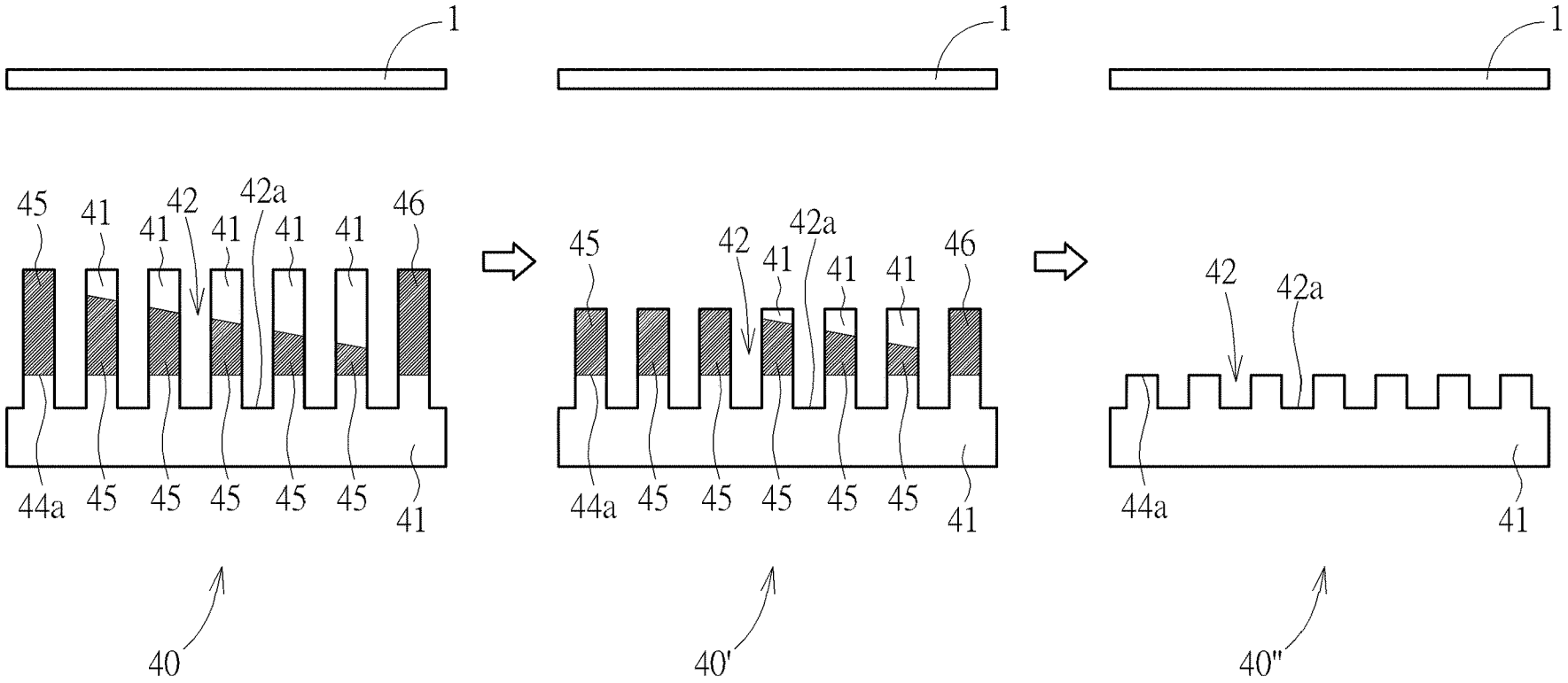
FIG. 8 shows the partial cross-sectional view structures of the wafer polishing pad of FIG. 7 respectively.

Referring to FIG. 7 and FIG. 8, FIG. 7 shows the top view schematic structures of a new wafer polishing pad, a polishing pad being polished partially and a used wafer polishing pad which is required to be replaced respectively according to the fourth preferred embodiment of the present invention. FIG. 8 shows the partial cross-sectional view structures of the wafer polishing pad of FIG. 7 respectively. As shown in FIG. 7 and FIG. 8, in the fourth embodiment of the present invention, at least one wafer 1 is provided, and a wafer polishing pad (or a disc) 40 is used to polish the wafer 1, wherein the left wafer polishing pad 40 is a new wafer polishing pad before used, the central wafer polishing pad 40' is a wafer polishing pad being polished partially, but still not need to be replaced, and the right wafer polishing pad 40" is in a state before the wafer polishing pad needs to be replaced. FIG. 8 shows the cross section views of the wafer polishing pad 40, the wafer polishing pad 40' and the wafer polishing pad 40" respectively. The warning element 44 is preferably made of the material same as the material of the polishing material layer 41, but the warning element 44 and the polishing material layer 41 have different colors, such as polyimide, but not limited thereto. In practical, during the process for forming the wafer polishing pad 40, a portion of the polishing material layer 41 can be dyed or can be made by other suitable processes to produce the warning element 44. In addition, in the present embodiment, the warning element 44 has a first portion and a second portion, the first portion 45 may cross a plurality of recess, and from the cross-sectional view, the first portion 45 has at least one slope, such as a trapezoidal structure or a triangular cross-sectional structure, and the second portion 46 is a structure having a vertical sidewall. The present embodiment is characterized in that only a portion of the first portion 45 is exposed at the beginning, when the wafer polishing pad 40 is depleted, more first portion 45 is exposed. Therefore, from the top view, the second portion 46 may be used as a reference position, when the first portion 45 is closer to the second portion 46, it means that it is approaching the time to replace the wafer polishing pad. Then, when the wafer polishing pad is depleted, and needs to be replaced (see the wafer polishing pad 40" on the right side), the warning element 44 may be completely removed and cannot be seen again, it means that when the user found the warning element 44 disappeared, the wafer polishing pad needs to be replaced. It is to be noted that the bottom surface 44*a* of the warning element 44 needs to be higher than the bottom surface 42*a* of the recess 42, to ensure that the wafer polishing pad is replaced before the recess 42 is fully flattened.

In addition, in the above embodiment, the first portion 45 may also be replaced by a stepped structure, that is, a flat top surface structure having a plurality of different levels, which is also within the scope of the present invention.

Figure 10:
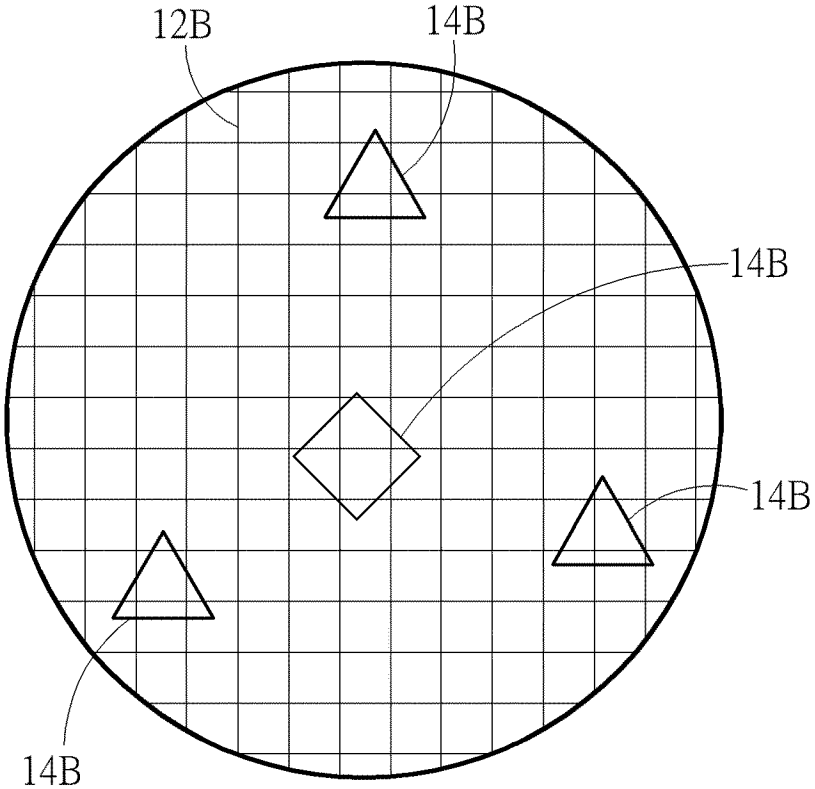
FIGS. 9 to 10 illustrate the schematic view of the structure of the other possible embodiments of the wafer polishing pad of the present invention.
Figure 9:
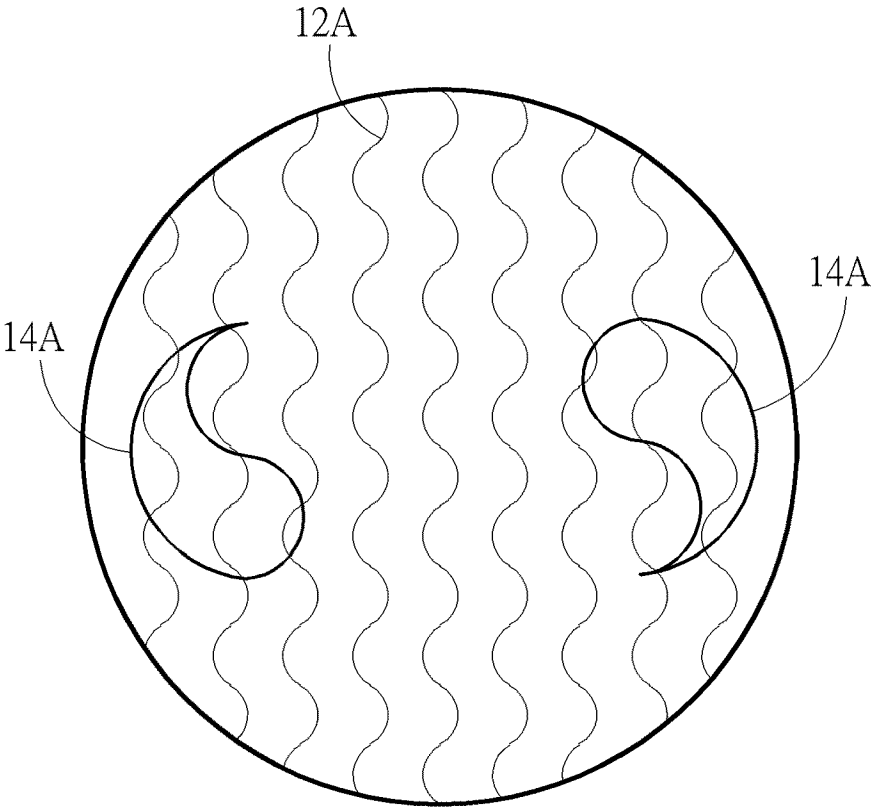

In other embodiments of the present invention, the shape of the warning element or the recess may be changed. For example, the warning elements may include such as ring, rectangular, triangular, circular or other irregular shapes, etc., and the recess are not limited to concentric annular arrangement, other embodiments may include such as wavy, zigzag, or lattice shape recess. For example, FIG. 9 and FIG. 10 illustrate other possible embodiments of the wafer polishing pads of the present invention. The shapes, the position and the number of the warning elements 14A and 14B of the wafer polishing pads shown in FIG. 9 and FIG. 10 are different, and the shapes of the recess 12A and 12B of the wafer polishing pads shown in FIG. 9 and FIG. 10 are also different. It is to be understood that the invention is not limited thereto and that other variations in the number, size and arrangement are also within the scope of the present invention.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A wafer polishing pad, comprising:

a polishing material layer;

a plurality of recesses formed on a top surface polishing material layer, wherein the plurality of recesses do not comprise the polishing material layer disposed therein; and a warning element disposed within the polishing material layer, wherein the warning element and the polishing material layer have different colors, wherein the warning element comprises an upper half and a lower half, the upper half comprises a plurality of concentric annular structures, the lower half is an annular structure, and wherein each upper half of the warning element is disposed between two adjacent recesses.

2. The wafer polishing pad of claim 1, wherein the polishing material layer and the warning element comprise the same material.

3. A wafer polishing pad, comprising:

a polishing material layer;

a plurality of recesses formed on a top surface polishing material layer, wherein the plurality of recesses do not comprise the polishing material layer disposed therein; and a warning element disposed within the polishing material layer, wherein the warning element and the polishing material layer have different colors, wherein the warning element has a first portion and a second portion, wherein the first portion has at least one slope, and the second portion is a structure having a vertical sidewall, and wherein the second portion of the warning element is disposed between two adjacent recesses.

4. The wafer polishing pad of claim 3, wherein the polishing material layer and the warning element comprise the same material.

* * * * *